US011746980B2

(12) United States Patent
Gürtl et al.

(10) Patent No.: US 11,746,980 B2
(45) Date of Patent: Sep. 5, 2023

(54) ILLUMINATION APPARATUS FOR A MOTOR VEHICLE HEADLIGHT

(71) Applicant: ZKW Group GmbH, Wieselburg (AT)

(72) Inventors: Josef Gürtl, Kilb (AT); Alexander Hacker, Wilhelmsburg (AT)

(73) Assignee: ZKW Group GmbH, Wieselburg (AT)

( * ) Notice: Subject to any disclaimer, the term of this patent is extended or adjusted under 35 U.S.C. 154(b) by 84 days.

(21) Appl. No.: 17/623,444

(22) PCT Filed: Jun. 15, 2020

(86) PCT No.: PCT/EP2020/066448

§ 371 (c)(1),
(2) Date: Dec. 28, 2021

(87) PCT Pub. No.: WO2021/008793

PCT Pub. Date: Jan. 21, 2021

(65) Prior Publication Data

US 2022/0349545 A1 Nov. 3, 2022

(30) Foreign Application Priority Data

Jul. 17, 2019 (EP) ..... 19186770

(51) Int. Cl.
*F21S 41/29* (2018.01)
*F21S 41/143* (2018.01)
*F21S 41/153* (2018.01)

(52) U.S. Cl.
CPC ..... *F21S 41/295* (2018.01); *F21S 41/143* (2018.01); *F21S 41/153* (2018.01)

(58) Field of Classification Search
CPC ..... F21S 41/295; F21S 41/143; F21S 41/153
See application file for complete search history.

(56) References Cited

U.S. PATENT DOCUMENTS 10,578,272 B2 3/2020 Nykerk et al.
10,718,483 B2 * 7/2020 Fischer ..... F21S 41/143
(Continued)

FOREIGN PATENT DOCUMENTS

EP 2827049 A1 1/2015
EP 3492804 A1 6/2019

OTHER PUBLICATIONS

International Search Report for PCT/EP2020/066448 dated Oct. 12, 2020 (10 pages).

*Primary Examiner* — Matthew J. Peerce
(74) *Attorney, Agent, or Firm* — Eversheds Sutherland (US) LLP

(57) ABSTRACT

The invention relates to an illumination device (10) for a motor vehicle headlight, which illumination device (10) has at least one projection device (100), which projection device (100) is arranged on a support frame (50) of the illumination device (10), wherein the at least one projection device (100) comprises the following:

Figure 1:
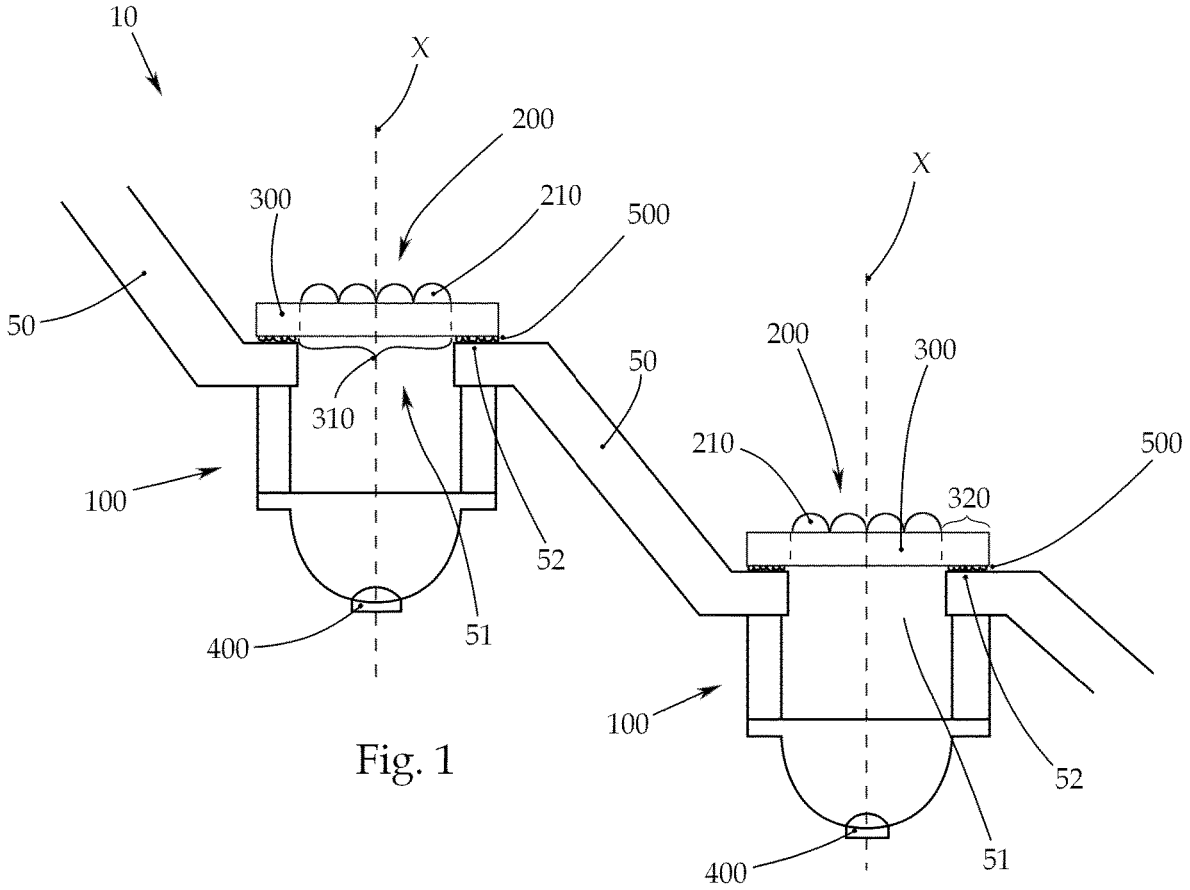

at least one micro-optics array (200), which has a plurality of micro-optics (210) arranged in a matrix-like manner in a plane orthogonal to a main emission direction (X) of the projection device (100), at least one substrate layer (300), on which the at least one micro-optics array (200) is arranged, wherein the at least one micro-optics array (200) is arranged on an optically active section (310) of the substrate layer (300), which optically active section (310) is at least partially light-permeable, at least one light source (400), which is designed to emit light beams, wherein the light beams are coupled into the optically active section (310) of the substrate layer (300) and coupled out through the at least one micro-optics array (200) in front of the illumination device (10) as light distribution, wherein the substrate layer (Continued)

(300) comprises an edge section (320) surrounding the optically active section (310) and projecting in a partially planar extension of the optically active section (310), wherein the edge section (320) is attached to the support frame (50) at least in sections by means of an adhesive (500).

9 Claims, 1 Drawing Sheet

(56) References Cited

U.S. PATENT DOCUMENTS

| | | | | |
|---|---|---|---|---|
| 11,060,680 | B2 * | 7/2021 | Niu | B60Q 1/549 |
| 2008/0043485 | A1 * | 2/2008 | Koerner | F21S 41/55<br>362/521 |
| 2018/0106450 | A1 * | 4/2018 | Kamau | F21V 5/002 |

* cited by examiner

ILLUMINATION APPARATUS FOR A MOTOR VEHICLE HEADLIGHT

The invention relates to an illumination device for a motor vehicle headlight, which illumination device has at least two projection devices, which projection devices are arranged on a support frame of the illumination device, wherein the at least two projection devices comprise the following:

- at least one micro-optics array, which has a plurality of micro-optics arranged in a matrix-like manner in a plane orthogonal to a main emission direction of the projection device,
- at least one substrate layer, on which the at least one micro-optics array is arranged, wherein the at least one micro-optics array is arranged on an optically active section of the substrate layer, which optically active section is at least partially light-permeable,
- at least one light source, which is designed to emit light beams, wherein the light beams are coupled into the optically active section of the substrate layer and coupled out through the at least one micro-optics array in front of the illumination device as light distribution.

Light distribution is produced by an illumination device or its at least two projection devices, wherein the at least two or the plurality of projection devices have to be mounted on the support frame of the illumination device and subsequently adjusted. If there are a plurality of projection devices, these are also adjusted or aligned with respect to one another.

This is usually done by three-point attachments and adjustment screws on each projection device. For this purpose, several individual components have to be mounted and adjusted with respect to one another. This inevitably results in a large number of required components, high assembly costs and increased installation space. Furthermore, adjustment processes and the assembly of such projection devices are difficult, if not impossible, to automate.

EP 3 312 501 A1, EP 3 492 804 A1, EP 2 827 049 A2 and WO 2016/191321 A1 show illumination devices from the prior art.

It is an object of the invention to provide an improved illumination device.

This object is achieved by virtue of the fact that the substrate layer comprises an edge section surrounding the optically active section and projecting in a partially planar extension of the optically active section, wherein the edge section is attached to the support frame at least in sections by means of an adhesive, wherein the support frame comprises an opening associated with each projection device, wherein the openings have a peripheral edge region, wherein the edge region corresponds to the edge section of the at least one substrate layer and the edge section can be attached to the edge region of the opening by means of an adhesive.

In the context of the present invention, the term "optically transparent" or "translucent material" is understood to mean a material having a transmittance T greater than 0.88, preferably greater than 0.999. The specified transmittance preferably applies to light in a wavelength range between about 400 nm and about 700 nm (i.e. visible light).

The at least one substrate layer and the at least one micro-optics array are preferably arranged in parallel to each other and perpendicular to the optical axis or the main emission direction of the projection device. The optical axis of the projection device preferably coincides with the main emission direction of the motor vehicle headlight if the projection device is correctly installed in such a headlight.

When installing or assembling the at least one projection device, it can be provided that the adhesive is applied at least partially to the support frame and/or edge section of the substrate layer. The micro-optics array, which is arranged on the substrate layer, is then positioned in front of the support frame, wherein the light source is switched on, illuminating the micro-optics array. The light distribution already created by this is measured and the micro-optics array adjusted and finally aligned on the support frame. The adhesive is then cured. This process can be repeated for further projection devices of the illumination device.

Thanks to the illumination device according to the invention, the required installation space, for example in a motor vehicle headlight, can be considerably reduced.

It can be provided that the at least one substrate layer is made of glass.

In terms of stability and thermal resistance, it can be particularly advantageous to use the at least one substrate layer made of glass. A glass substrate layer increases the stability and strength of the projection device, enabling automated manufacturing process, for example. Moreover, a glass substrate layer offers a high level of transparency and increases the chemical and thermal resistance of the projection device.

It can be provided that the substrate layer has a thickness of 0.5 to 4 mm, preferably a thickness of 1.1 mm.

It can be provided that the at least one micro-optics array is made of silicone.

Using transparent silicone means that a higher operating temperature and thus a higher light density can be achieved. In addition, the use of transparent silicone increases the robustness of the projection device. Robust refers to the permanent connection between the micro-optics array and the substrate layer or permanent adhesion of the at least one micro-optics array to the at least one substrate layer.

The substrate layer should therefore, according to the invention, be made from a material that has a good light transparency and is dimensionally stable enough. Dimensionally stable enough in this context means that the substrate layer supports the micro-optics array made of (soft) silicone and does not lose its shape, i.e. is resistant in shape to heat and the like, both during the formation of the micro-optics array on the first surface of the substrate layer and during the use of the projection device in a motor vehicle headlight.

It can be provided that the at least one micro-optics array is composed of micro-optics formed integrally with one another.

It can be provided that the edge section of the substrate layer is not optically active.

It can be provided that the edge section of the substrate layer is opaque.

It can be provided that the extension of the opening corresponds at least to the extension of the optically active section of the substrate layer.

It can be provided that the edge section completely surrounds the optically active section of the substrate layer.

It can be provided that the edge section projects beyond the optically active section of the substrate layer in the radial direction with respect to the main emission direction of the at least one projection device.

Figure 2:
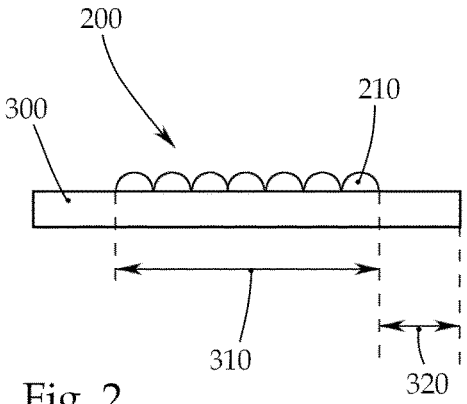
Figure 3:
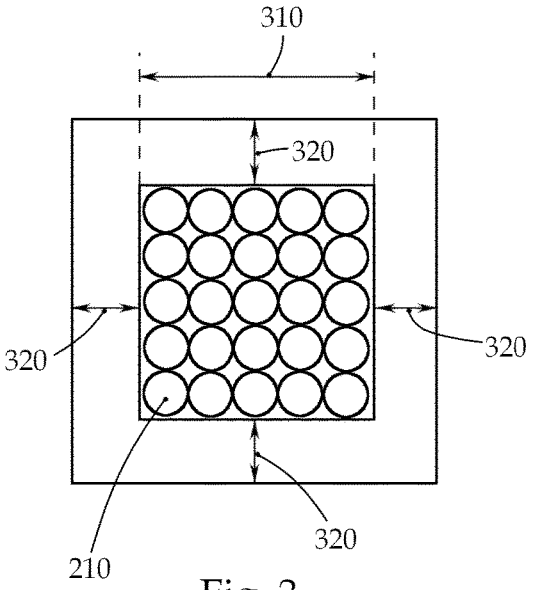

The invention is explained below in more detail based on exemplary drawings. In the drawings, FIG. 1 shows a cross-section of an exemplary illumination device having two projection devices, which respectively comprise a micro-optics array on a substrate layer and are arranged on a support frame of the illumination device, FIG. 2 shows a cross-section of an exemplary micro-optics array on a substrate layer, wherein the micro-optics array is arranged on an optically active section of the substrate layer, and wherein the substrate layer furthermore has an edge section surrounding and projecting from the optically active section, and FIG. 3 shows a plan view of the exemplary micro-optics array on the substrate layer from FIG. 2.

FIG. 1 shows an exemplary illumination device 10 for a motor vehicle headlight, which illumination device 10 has two projection devices 100 in the example shown, wherein the projection devices 100 are arranged on a support frame 50 of the illumination device 10.

The projection devices 100 respectively comprise a micro-optics array 200, which has a plurality of micro-optics 210 arranged in a matrix-like manner in a plane orthogonal to a main emission direction X of the projection device 100.

The micro-optics arrays 200 are respectively arranged on a substrate layer 300 of the respective projection device 100, wherein the micro-optics array 200 is arranged on an optically active section 310 of the respective substrate layer 300, which optically active section 310 is at least partially light-permeable.

Furthermore, a projection device 100 comprises a light source 400, which is designed to emit light beams, wherein the light beams are coupled into the optically active section 310 of the substrate layer 300 and coupled out through the micro-optics array 200 in front of the illumination device 10 as light distribution.

Each substrate layer 300 further comprises an edge section 320 completely surrounding the optically active section 310 and projecting in a planar extension of the optically active section 310, wherein the edge section 320 is attached to the support frame 50 at least in sections by means of an adhesive 500. The edge section 320 is above or in front of the optically active section 310 of the substrate layer 300, i.e. in the radial direction with respect to the main emission direction X of the respective projection device 100.

As shown in FIG. 1, the support frame 50 has an opening 51 associated with each projection device 100, wherein the opening 51 has a peripheral edge region 52, which edge region 52 corresponds to the edge section 320 of the respective substrate layer 300, wherein the edge section 320 can be attached to the edge region 52 of the opening 51 by means of the adhesive 500. In this case, the extension of the opening 51 corresponds to the extension of the optically active section 310 of the substrate layer 300.

FIG. 2 shows an exemplary substrate layer 300 with an optically active section 310 and an edge section 320 projecting from the optically active section 310, wherein a micro-optics array 200 is arranged on or attached to the optically active section 320. The edge section 320 is not optically active in general and can be opaque, i.e. the substrate layer 300 can be manufactured from two different materials or in at least two work steps. The substrate layer can be made of glass in the examples shown, wherein the micro-optics array 200 is made of silicone.

FIG. 3 shows the exemplary substrate layer 300 with the micro-optics array 200 from FIG. 2 in a view from above. In the example shown, the micro-optics array 200 is composed of micro-optics 210 formed integrally with one another.

| REFERENCE LIST | |
|---|---|
| Illumination device | 10 |
| Support frame | 50 |
| Opening | 51 |
| Edge region (opening) | 52 |
| Projection device | 100 |
| Micro-optics array | 200 |
| Micro-optics | 210 |
| Substrate layer | 300 |
| Optically active section | 310 |
| Edge section | 320 |
| Light source | 400 |
| Adhesive | 500 |
| Main emission direction | X |

The invention claimed is:

1. An illumination device (10) for a motor vehicle headlight, the illumination device (10) comprising:

a support frame; and at least two projection devices (100) arranged on the support frame (50), wherein the at least two projection devices (100) comprise:

at least one micro-optics array (200), which has a plurality of micro-optics (210) arranged in a matrix-like manner in a plane orthogonal to a main emission direction (X) of the projection device (100);

at least one substrate layer (300) on which the at least one micro-optics array (200) is arranged, wherein the at least one micro-optics array (200) is arranged on an optically active section (310) of the substrate layer (300), which optically active section (310) is at least partially light-permeable; and at least one light source (400), which is designed to emit light beams, wherein the light beams are coupled into the optically active section (310) of the substrate layer (300) and coupled out through the at least one micro-optics array (200) in front of the illumination device (10) as light distribution, wherein:

the substrate layer (300) comprises an edge section (320) surrounding the optically active section (310) and projecting in a partially planar extension of the optically active section (310), wherein the edge section (320) is attached to the support frame (50) at least in sections by means of an adhesive (500), and the support frame (50) comprises an opening (51) associated with each projection device (100), wherein the openings (51) have a peripheral edge region (52), wherein the edge region (52) corresponds to the edge section (320) of the at least one substrate layer (300) and the edge section (320) can be attached to the edge region (52) of the opening (51) by means of the adhesive (500).

2. The illumination device as claimed in claim 1, wherein the at least one substrate layer (300) is made of glass.

3. The illumination device as claimed in claim 1, wherein the at least one micro-optics array (200) is made of silicone.

4. The illumination device as claimed in claim 1, wherein the at least one micro-optics array (200) is composed of micro-optics (210) formed integrally with one another.

5. The illumination device as claimed in claim 1, wherein the edge section (320) of the substrate layer (300) is not optically active.

6. The illumination device as claimed in claim 1, wherein the edge section (320) of the substrate layer (300) is opaque.

7. The illumination device as claimed in claim 1, wherein the extension of the opening (51) corresponds at least to the extension of the optically active section (310) of the substrate layer (300).

8. The illumination device as claimed in claim 1, wherein the edge section (320) completely surrounds the optically active section (310) of the substrate layer (300).

9. The illumination device as claimed in claim 1, wherein the edge section (320) projects beyond the optically active section (310) of the substrate layer (300) in the radial direction with respect to the main emission direction (X) of the at least one projection device (100).

* * * * *